US009410689B2

(12) United States Patent
Kato et al.

(10) Patent No.: US 9,410,689 B2
(45) Date of Patent: Aug. 9, 2016

(54) LIGHTING APPARATUS

(71) Applicant: Kabushiki Kaisha Toshiba, Tokyo (JP)

(72) Inventors: Mitsuaki Kato, Kanagawa (JP); Hiroshi Ohno, Kanagawa (JP); Katsumi Hisano, Chiba (JP); Masataka Shiratsuchi, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 14/479,616

(22) Filed: Sep. 8, 2014

(65) Prior Publication Data

US 2015/0085492 A1 Mar. 26, 2015

(30) Foreign Application Priority Data

Sep. 24, 2013 (JP) ..... 2013-197578

(51) Int. Cl.

| | |
|---|---|
| ***F21V 29/00*** | (2015.01) |
| ***F21K 99/00*** | (2016.01) |
| ***F21V 29/506*** | (2015.01) |
| ***F21V 19/00*** | (2006.01) |
| *F21Y 101/02* | (2006.01) |
| *F21V 5/04* | (2006.01) |
| *F21Y 111/00* | (2016.01) |

(52) U.S. Cl.

CPC ..... *F21V 29/506* (2015.01); *F21K 9/1355* (2013.01); *F21K 9/52* (2013.01); *F21V 19/005* (2013.01); *F21V 5/04* (2013.01); *F21Y 2101/02* (2013.01); *F21Y 2111/002* (2013.01)

(58) Field of Classification Search

CPC ..... F21V 29/004; F21K 9/50; F21Y 2101/02
See application file for complete search history.

(56) References Cited

U.S. PATENT DOCUMENTS

| | | | | |
|---|---|---|---|---|
| 8,479,119 | B2 | 7/2013 | Hoerentrup et al. | |
| 8,607,160 | B2 | 12/2013 | Hoerentrup et al. | |
| 8,702,257 | B2 | 4/2014 | Lenk et al. | |
| 2007/0044038 | A1 | 2/2007 | Hoerentrup et al. | |
| 2009/0257220 | A1 | 10/2009 | Lenk et al. | |
| 2011/0074290 | A1 * | 3/2011 | Sakai | F21K 9/135 315/32 |
| 2012/0218768 | A1 | 8/2012 | Hisano et al. | |
| 2013/0223077 | A1 | 8/2013 | Kato et al. | |
| 2013/0268896 | A1 | 10/2013 | Hoerentrup et al. | |
| 2014/0053104 | A1 | 2/2014 | Hoerentrup et al. | |

(Continued)

FOREIGN PATENT DOCUMENTS

| | | |
|---|---|---|
| CN | 102032480 | 4/2011 |
| CN | 204328510 | 5/2015 |

(Continued)

OTHER PUBLICATIONS

Notification of the First Office Action from the State Intellectual Property Office of the People's Republic of China mailed Jan. 25, 2016, in counterpart Chinese Patent Application No. 201410493518.3; 15 pages.

*Primary Examiner* — Elmito Breval
(74) *Attorney, Agent, or Firm* — Finnegan, Henderson, Farabow, Garrett & Dunner, LLP

(57) ABSTRACT

According to one embodiment, a lighting apparatus comprises a light source configured to generate heat, a transparent heat transfer member located near the light source and having transparency and heat conductivity, and a means for transferring heat from the light source to the transparent heat transfer member.

17 Claims, 10 Drawing Sheets

(56) References Cited

U.S. PATENT DOCUMENTS

| | | | |
|---|---|---|---|
| 2014/0145590 | A1 | 5/2014 | Sakai et al. |
| 2015/0085492 | A1 | 3/2015 | Kato et al. |

FOREIGN PATENT DOCUMENTS

| | | |
|---|---|---|
| EP | 2 532 949 | 12/2012 |
| JP | 2006-310057 | 11/2006 |
| JP | 2009-93926 | 4/2009 |
| JP | 2009-97103 | 5/2009 |
| JP | 2009-535783 | 10/2009 |
| JP | 2009-267082 | 11/2009 |
| JP | 2010-225507 | 10/2010 |
| JP | 4840185 | 10/2011 |
| JP | 2012-64526 | 3/2012 |
| JP | 2012-181966 | 9/2012 |
| JP | 2013-33547 | 2/2013 |
| JP | 2013-64623 | 4/2013 |
| JP | 2013-175406 | 9/2013 |
| WO | WO-2012/139644 | 10/2012 |

* cited by examiner

LIGHTING APPARATUS

CROSS-REFERENCE TO RELATED APPLICATIONS

This application is based upon and claims the benefit of priority from prior Japanese Patent Application No. 2013-197578, filed Sep. 24, 2013, the entire contents of which are incorporated herein by reference.

FIELD

Embodiments described herein relate generally to a lighting apparatus with a light source that generates heat.

BACKGROUND

Some lighting apparatuses using LED light sources are comprised of a light transmitting optical member in order to control the light distribution characteristics of light from the LED light source. The use of an optical member generally reduces a light output ratio (the light output ratio refers to the ratio of the total luminous flux emitted by the lighting apparatus to the total luminous flux from the light source). To prevent such reduction, it is preferable to use an optical member with a high transmittance.

Furthermore, this type of lighting apparatus comprises a heat transfer member for receiving heat from the LED light source to emit the heat to the outside of the LED source. For example, the heat transfer member is a main body that contacts a back surface of a substrate with the LED light source mounted thereon. For increased heat radiation efficiency, it is preferable that heat is transferred not only to the heat transfer member, but also to the optical member so that heat is also radiated from a surface of the optical member. In this case, it is preferable that the heat-resistant temperature of the optical member is equivalent to the heat-resistant temperature of the LED light source.

Acrylic, which is used as a general optical member, has a high light transmittance, but is lower than LEDs in heat-resistant temperature and has a small coefficient of heat conductivity. Similarly, general polycarbonate has a high heat-resistant temperature, but has a small coefficient of heat conductivity and is lower than acrylic in transmittance. Transparent ceramics have a high heat-resistant temperature and a large coefficient of heat conductivity, but are lower than acrylic in light transmittance and are very expensive.

In other words, no appropriate optical member is available which has excellent heat resistance and which has a high light transmittance and a large coefficient of heat conductivity. This prevents achievement of a satisfactory light output ratio and exhibition of satisfactory heat radiation performance.

Thus, it is desirable to develop a lighting apparatus which has a high light output ratio and which has excellent heat radiation and heat resistance.

DETAILED DESCRIPTION

According to one embodiment, a lighting apparatus comprises a light source configured to generate heat, a transparent heat transfer member located near the light source and having transparency and heat conductivity, and a means for transferring heat from the light source to the transparent heat transfer member.

Various embodiments will be described hereinafter with reference to the accompanying drawings.

Now, as several embodiments of the lighting apparatus, LED light bulbs 101, 102, 103, 104, 105, 106, 107, and 108 which are detachably attached to a socket provided on a ceiling or the like in a room, will be described.

First Embodiment

Figure 1B:
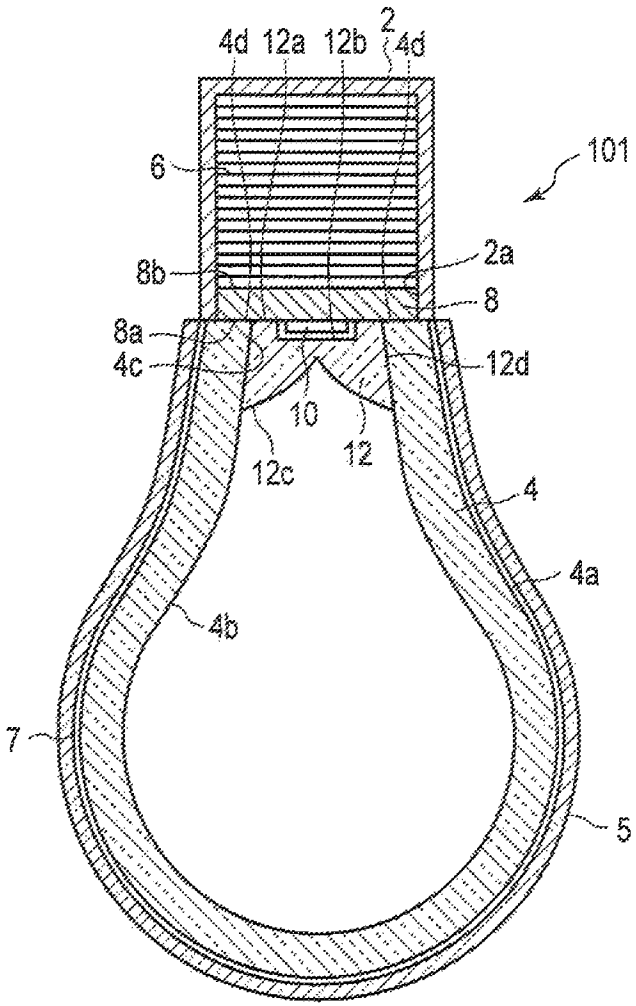
FIG. 1B is a cross-sectional view of the lighting apparatus according to the first embodiment.
Figure 1A:
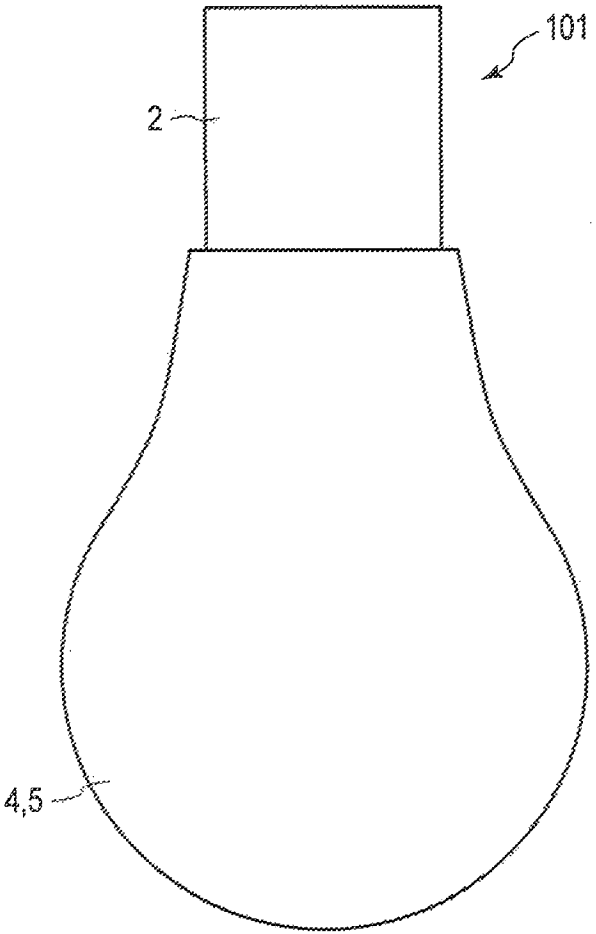
FIG. 1A is a diagram of the appearance of a lighting apparatus according to a first embodiment.

FIG. 1A is a diagram of the appearance of a LED light bulb 101 according to a first embodiment. FIG. 1B is a cross-sectional view of the LED light bulb 101 vertically divided into two portions along a plane through the tube axis of the LED light bulb 101.

As shown in FIG. 1A, the LED light bulb 101 comprises a base 2 screwed into the socket (not shown in the drawings) on the ceiling, a hollow transparent globe 4 (transparent heat transfer member) shaped generally like a spherical shell, and a protective member 5 that covers a surface 4*a* of the globe 4. The base 2 electrically and mechanically connects the LED light bulb 101 to the socket.

In an illustrated state in which the LED light bulb 101 is attached to a socket, the base 2 is positioned above the globe 4 in the vertical direction. The base 2 is a cylindrical bottomed metal and comprises a circular opening 2*a* at a lower end of the base 2 shown in FIG. 1B. When electricity is supplied to the LED light bulb 101 via the socket using a power supply or the like in the room, a light source 10 connected to the base 2 emits light. The light then exits through the surface 4*a* of the globe 4 provided under the base 2 as shown in FIG. 1A. The light then passes through the protective member 5 to light the inside of the room.

As shown in FIG. 1B, the LED light bulb 101 is internally provided with a power supply circuit 6, a substrate 8 (back surface side heat transfer member), the light source 10, and a lens 12.

The power supply circuit 6 is housed and located inside the base 2. The power supply circuit 6 feeds power supplied through the socket on the ceiling to the light source 10. Specifically, an AC voltage is applied to the base 2 through the socket, and the power supply circuit 6 converts the AC voltage (for example, 100V) into a DC voltage. The power supply circuit 6 then applies the DC voltage to the light source 10. The base 2 and the power supply circuit 6 are electrically connected together using a wire (not shown in the drawings). The power supply circuit 6 and the light source 10 are electrically connected together using a wire (not shown in the drawings).

The substrate 8 is shaped like a disc and comprises the light source 10 on a front surface 8*a* of the substrate 8. The substrate 8 is mounted in contact with the base 2 so as to close the opening 2*a* of the base 2. The power supply circuit 6 is located on a back surface 8*b* side of the substrate 8. The substrate 8 is joined to the opening 2*a* of the base 2 at a peripheral portion of the substrate 8 via a junction member (not shown in the drawings). The junction member is preferably a material such as PBS or PEEK which has insulation properties, heat resistance, and combustion resistance.

The substrate 8 can be formed of, for example, metal comprising aluminum, copper, or iron, or ceramics. The substrate 8 is preferably formed of a material having a coefficient of heat conductivity at least greater than the globe 4 and the protective member 5; for example, a resin with high heat resistance.

The light source 10 has, for example, a LED chip mounted on the front surface 8*a* of the substrate 8 and a transparent sealing member formed of resin and sealing the LED chip on the front surface 8*a* of the substrate 8. Alternatively, the light source 10 may be a LED element which is separate from the substrate 8 and which comprises a LED chip attached to and sealed on a base material. The light source 10 is supplied with electricity from the power supply circuit 6 to emit visible light. In this case, a surface of the sealing member sealing the LED chip functions as a light emitting surface.

One or more light sources 10 are provided on the front surface 8*a* of the substrate 8 to emit visible light, for example, white light. The light source 10 emits light in a direction away from the front surface 8*a* of the substrate 8. As an example, a LED chip that generates blue light with a wavelength of 450 nm is used as the light source. The LED chip is sealed with a resin material containing a phosphor which absorbs blue light to generate yellow light with a wavelength near 560 nm.

In particular, when a LED element separate from the substrate 8 is used as the light source 10, the LED element is attached to the front surface 8*a* of the substrate 8 via a sheet, an adhesive tape, an adhesive, or thermal grease (not shown in the drawings) which has excellent heat conduction. This allows heat generated by the light source 10 to be sufficiently transferred to the substrate 8, enabling a reduction in the contact heat resistance between the light source 10 and the substrate 8. When electric insulation is needed between the front surface 8*a* of the substrate 8 and the LED element, the light source 10 is provided in contact with the front surface 8*a* of the substrate 8 via an electrically insulating material (an insulation sheet or the like).

The lens 12 comprises a back surface 12*a* shaped generally like a ring and provided in contact with the front surface of the substrate 8. The back surface 12*a* comprises a recess 12*b* formed in the center of the back surface 12*a* and in which the light source 10 is housed and arranged so as not to contact the lens 12. An inner surface of the recess 12*b* functions as a light receiving surface located near and opposite the light emitting surface of the light source 10. A front surface 12*c* of the lens 12 provides a curved surface that refracts and transmits light passing through the front surface to distribute the light in a desired direction. The shape of the front surface 12*c* is not described here in detail.

The lens 12 does not necessarily need to be arranged in noncontact with the light source 10 as shown in FIG. 1B, but may be arranged in tight contact with the light emitting surface of the light source 10. According to the first embodiment, the shape and size of the recess 12*b* are designed so that the lens 12 lies opposite the light emitting surface of the light source 10 via a gap of less than 1 mm. In any case, the surface of the lens 12 is provided with an area (in the first embodiment, an inner surface of the recess 12*b*) lying near and opposite the light emitting surface of the light source 10 to allow the lens 12 to be located near the light emitting surface of the light source 10. This enables an increase in the rate of incidence of light on the lens 12.

The lens 12 is formed of a material which is transparent to visible light and which has a heat-resistant temperature (100° C. or higher) equivalent to the heat-resistant temperature of the light source 10 and a coefficient of heat conductivity (1.0 W/mK or higher) greater than the coefficient of heat conductivity of a general resin, for example, glass. The lens 12 is attached to the globe 4 so that a side surface 12*d* is in tight contact with an inner surface 4*b* of the globe 4.

Specifically, the lens 12 is attached to the front surface 8*a* of the substrate 8 via a sheet, an adhesive tape, an adhesive, thermal grease, a screw, or the like (not shown in the drawings) which has excellent heat conduction. This allows heat to be sufficiently transferred from the front surface 8*a* of the substrate 8 to the back surface 12*a* of the lens 12, enabling a reduction in the contact heat resistance between the front surface 8*a* of the substrate 8 and the back surface 12*a* of the lens 12.

Furthermore, the lens 12 is located in tight contact with the inner surface 4*b* of the globe 4 via a transparent sheet or adhesive tape, a transparent adhesive, thermal grease, or the like that has excellent heat conduction. This allows heat directly transferred from the light source 10 to the lens 12 and via the front surface 8*a* of the substrate 8 to be sufficiently transferred to the inner surface 4*b* of the globe 4, enabling a reduction in the contact heat resistance between the side surface 12*d* of the lens 12 and the inner surface 4*b* of the globe 4.

The globe 4 is shaped to have a circular opening 4*c* formed by bulging an upper end of the hollow spherical shell toward the base 2. The globe 4 is transparent to visible light (a transmittance of 92% or higher) and has a heat-resistant temperature (100° C. or higher) equivalent to the heat-resistant temperature of the light source 10, and a coefficient of heat conductivity (1.0 W/mk or higher) greater than the coefficient of heat conductivity of general resin, for example, glass.

The inner surface 4*b* of the globe 4 lays opposite the light source 10 and the lens 12. The protective member 5 is provided on an outer surface of the globe 4 via a thin air space 7. The protective member 5 covers the entire surface 4*a* of the globe 4.

An opening-4*c*-side end surface 4*d* of the globe 4 is in contact not only with the front surface 8*a* of the substrate 8, but also with an opening-2*a*-side end surface of the base 2. Specifically, the end surface 4*d* of the globe 4 is provided in tight contact with the front surface 8*a* of the substrate 8 and the end surface of the base 2 via a sheet, an adhesive tape, an adhesive, thermal grease, or the like (not shown in the drawings) which has excellent heat conduction.

According to the first embodiment, the lens 12 and the globe 4 are separate from each other. However, the first embodiment is not limited to this, and the lens 12 and the globe 4 may be integrated with each other. In this case, the junction portion between the side surface 12*d* of the lens 12 and the inner surface 4*b* of the globe 4 offers no heat resistance, allowing the heat radiation performance of the LED light bulb 101 to be correspondingly improved.

Preferably, the protective member 5 is transparent or translucent to visible light (a transmittance of 85% or higher) and has a heat-resistant temperature (100° C. or higher) equivalent to the heat-resistant temperature of the light source 10, and a mechanical strength sufficient to withstand impacts when dropped, and is formed of a flame-retardant material. The protective member 5 is formed using, for example, polycarbonate.

An inner surface of the protective member 5 lies opposite the surface 4*a* of the globe 4 via the air space 7. The protective member 5 may include an optical diffusion material. In this case, light entering the protective member 5 through the inner surface diffuses while passing through the protective member 5 and is emitted to the outside space through an outer surface of the protective member 5. This spreads the light.

The protective member 5 provides a function to transmit light, a function to protect the globe 4 from impact, and a function to prevent the globe 4 from being shattered when the globe 4 is broken. The protective member 5 also serves to radiate heat transferred from the globe 4, to the outside space.

When the LED light bulb 101 configured as described above is turned on, light emitted through the light emitting surface of the light source 10 passes through the lens 12, the globe 4, and the protective member 5 and radiates on an outer portion of the LED light bulb 101.

At this time, a portion of the light is reflected by the front surface 12*c* of the lens 12 at a light distribution angle, resulting in widely distributed light. Thus, light spread to some degree can be generated even if the globe 4 and the protective member 5 fail to be provided with a light diffusion property by containing a diffusion material in the globe 4 and the protective member 5, or by applying sandblasting to the globe 4 and the protective member 5. When both the globe 4 and the protective member 5 are formed of a transparent material containing no diffusion material or the like, the LED light bulb 101 is a clear light bulb.

Light transmitted through the lens 12 passes through the globe 4 and the protective member 5 without being affected and spreads throughout the globe 4 and the protective member 5. In this case, when a diffusion material is contained in the globe 4 and/or the protective member 5, or sandblasting is applied to the surfaces of the globe 4 and/or the protective member 5 so that light can diffuse through the globe 4 and/or the protective member 5, the light spreads more widely, leading to uniform brightness. According to the first embodiment, a diffusion material is contained in the protective member 5 to provide the protective member 5 with a light diffusion property. Thus, when at least one of the globe 4 and the protective member 5 contains a diffusion material, the LED light bulb 101 is a frosted light bulb.

As described above, according to the first embodiment, the lens 12 is located near and opposite the light emitting surface of the light source 10, and the relatively thick globe 4 is located in tight contact with the side surface 12*d* of the lens 12. This enables light emitted by the light source 10 to be efficiently transmitted to the globe 4, allowing the light to be efficiently transmitted via the globe 4. As a result, appropriate illumination light can be obtained.

On the other hand, heat generated by the light source 10 is transferred as described below and radiated to the outside of the LED light bulb 101.

First, heat from the light source 10 is transferred through the back surface side of the light source 10 to the substrate 8 and then throughout a light emitting section of the LED light bulb 101 via the globe 4, which is in contact with the front surface 8*a* of the substrate 8. Furthermore, the heat of the substrate 8 is transferred to the globe 4 via the lens 12, which is in contact with the front surface 8*a*, and to the space (air) in the globe 4 via the lens 12. Moreover, the heat of the light source 10 is transferred directly to the lens 12 via the recess 12*b* and then to the globe 4 and the space inside the globe 4. The heat thus transferred to the globe 4 is further transmitted to the protective member 5 through the air space 7 and radiated to the outside through the entire outer surface of the protective member 5.

Second, the heat of the light source 10 is transferred to the base 2 via the substrate 8. The heat transferred to the base 2 is further transmitted to the socket (not shown in the drawings) on the ceiling and then radiated. In the above description, by way of example, the light source 10 is a heat source. In addition, the power supply circuit 6 is also a heat source. Heat generated by the power supply circuit 6 is transferred to the back surface 8*b* of the substrate 8 and to the base 2.

As described above, according to the first embodiment, the heat of the light source 10 can be transferred throughout the LED light bulb 101 via a light guiding member (the globe 4, the protective member 5, and the lens 12) configured to guide light from the light source 10. This allows heat radiation performance to be improved.

The thicknesses of the globe 4, the protective member 5, and the air space 7 which are suitable to allow the LED light bulb 101 to exhibit excellent heat radiation performance according to the first embodiment, will be discussed below.

When the globe 4 is shaped approximately like a spherical shell and the tube axis is set to correspond to a central axis, longitudinal heat resistance $R_{t1}$ is expressed by:

[Formula 1]

$$R_{tl} = \frac{\ln\left\{\frac{(\cos\theta_2 - 1)(\cos\theta_1 + 1)}{(\cos\theta_2 + 1)(\cos\theta_1 - 1)}\right\}}{4\lambda\pi(r_2 - r_1)} \quad (\text{式 } 1)$$

Figure 9:
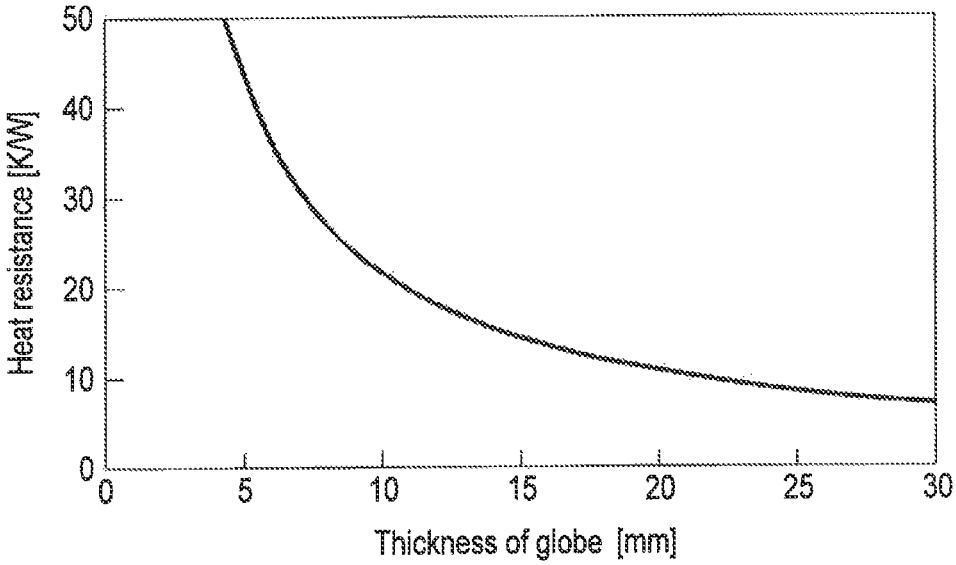
FIG. 9 is a graph showing the relation between the thickness and thermal resistance of a globe.

In Formula 1, the inner radius of the spherical shell is denoted by $r_1$, the outer radius of the spherical shell is denoted by $r_2$, latitude is denoted by $\theta_1$ and $\theta_2$, and the coefficient of heat conductivity is denoted by $\lambda$. A LED light bulb 101 including an E26 base 2 and having a diameter $\phi$ of 55 mm and an overall length of 98 mm has about 108 $cm^2$ in surface area except for the base 2. A spherical shell with the same surface area has an outer radius of about 30 mm. Taking the diameter of the base 2 into consideration, $\theta_2$ is about 153°, and the angle $\theta_1$, which divides the surface area of the sphere approximately into two portions, is about 87°. When a material for the globe 4 is glass (1.1 W/mK), the relation between the thickness and heat resistance of the globe 4 is as shown in FIG. 9. For heat radiation from the globe 4, $R_{t1}$ is preferably equal to or lower than 30K/W. Thus, the thickness of the globe 4 is preferably equal to or larger than approximately 7 mm.

In a heat radiation path extending through the globe 4 from the light source 10, the protective member 5 provides heat resistance. Furthermore, the globe 4 and the protective member 5 may be in tight contact with each other or a gap may be formed between the globe 4 and the protective member 5. When a gap is formed between the globe 4 and the protective member 5, the air space 7 between the globe 4 and the protective member 5 also offers heat resistance. When the globe 4, the air space 7, and the protective member 5 are each shaped approximately like a spherical shell, thermal resistance $R_{at}$ in a direction from the surface 4*a* of the globe 4 toward the inner surface of the protective member 5 is expressed by:

[Formula 2]

$$R_{at} = \frac{1/r_1 - 1/r_2}{2\lambda\pi(\cos\theta_1 - \cos\theta_2)} \quad (式\ 2)$$

Figure 10:
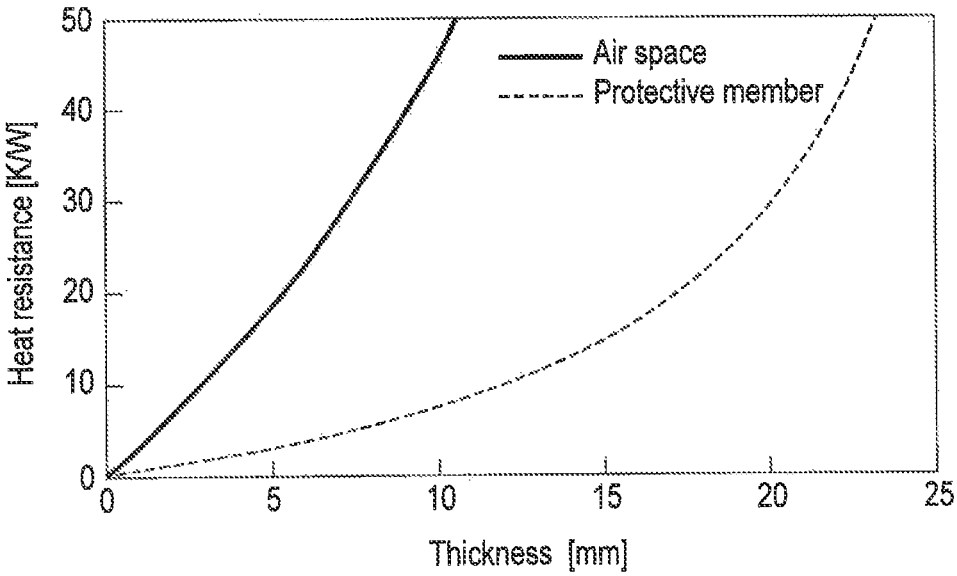
FIG. 10 is a graph showing the relation between the thickness and thermal resistance of an air space and the relation between the thickness and thermal resistance of a protective member.

In Formula 2, the inner radius of the spherical shell is denoted by $r_1$, the outer radius of the spherical shell is denoted by $r_2$, the latitude is denoted by $\theta_1$ and $\theta_2$, and the coefficient of heat conductivity is denoted by $\lambda$. An LED light bulb 101 with an overall length of 98 mm has about 108 $cm^2$ in surface area except for the base 2. A spherical shell with the same surface area has an outer radius of about 30 mm. Taking the diameter of the base 2 into consideration, $\theta_2$ is about 153° and $\theta_1$ is 0°. The relation between heat resistance and the thicknesses of the protective member 5 and the air space 7 is as shown in FIG. 10. To promote heat radiation from the globe 4, $R_{at}$ is preferably set equal to or lower than 30K/W. Thus, the thickness of the protective member 5 is preferably equal to or smaller than approximately 20 mm, and the thickness of the air space 7 is equal to or smaller than approximately 7 mm.

As described above, the LED light bulb 101 according to the first embodiment can be provided with a large emission area and high heat radiation performance by using the globe 4 with high transmissivity and strong heat resistance, and by setting the thickness of the globe 4 to an approximate value. Furthermore, light emission, light distribution, light radiation, and impact resistance can all be enhanced over a large area by providing the protective member 5, which covers the globe 4, with high temperature resistance, high mechanical strength, a diffusion material, and setting the thickness of the protective member 5 to an appropriate value. Additionally, the impact resistance performance of the LED light bulb 101 can further be improved by forming an appropriate spacing between the globe 4 and the protective member 5.

Furthermore, the globe 4 may include a scatterer inside or on the inner surface 4*b*. This enables a further increase in the light distribution angle of the LED light bulb 101.

The first embodiment employs the structure in which the protective member 5 covers the entire surface of the globe 4, but may be provided with a protective member 5 that covers a part of the globe 4. In this case, heat can be radiated not only from the protective member 5, but also directly from an exposed area of the surface 4*a* of the globe 4 which is not covered with the protective member 5.

Furthermore, instead of the protective member 5, a coating or a sheet may be applied to the surface 4*a* of the globe 4 in order to prevent possible light diffusion and scattering. This degrades light diffusivity and impact resistance, but enables a reduction in the heat resistance offered by the protective member 5 and the air space 7.

Additionally, a support member (not shown in the drawings) may be provided between the protective member 5 and the surface 4*a* of the globe 4. The provision of such a support member allows the appropriate gap 7 to be maintained between the protective member 5 and the surface 4*a* of the globe 4. Thus, the LED light bulb 101 can be provided with high mechanical strength, and the impact resistance of the LED light bulb 101 can be enhanced. Additionally, the use of a support member with a large coefficient of heat conductivity enables the heat radiation performance to be improved.

Furthermore, the first embodiment places no metal around the light source 10 as described above. Specifically, when the area of the light emitting surface of the light source 10 is denoted by A, no metal is placed within a distance d from the light source 10 in a direction in which light is emitted by the light source 10 through the light emitting surface (from −90° to +90°); the distance d is expressed by:

[Formula 3]

$$d \le \sqrt{\frac{4\pi}{A}} \quad (式\ 3)$$

In general, when no metal is provided around the light source 10 as in the case of the first embodiment, it is difficult to achieve a heat radiation path through which heat is let out. However, the first embodiment places, instead of metal, a light transmitting material with some degree of high heat conductivity near the light source 10 to achieve a heat radiation path for the light source 10.

Light emitted by the light source 10 has a luminance (the energy density of light) that increases with decreasing distance from the light emitting surface. Consequently, when metal or a light absorbing material is present near the light emitting surface, light is absorbed by the metal or light absorbing material, reducing the optical output ratio. Thus, preferably, no such light absorbing material is placed around the light source 10.

Furthermore, according to the first embodiment, a space is provided inside the globe 4. However, the first embodiment is not limited to this, and the globe 4 may be formed to be solid. This minimizes the heat resistance expressed by Formula 1.

Second Embodiment

Figure 2B:
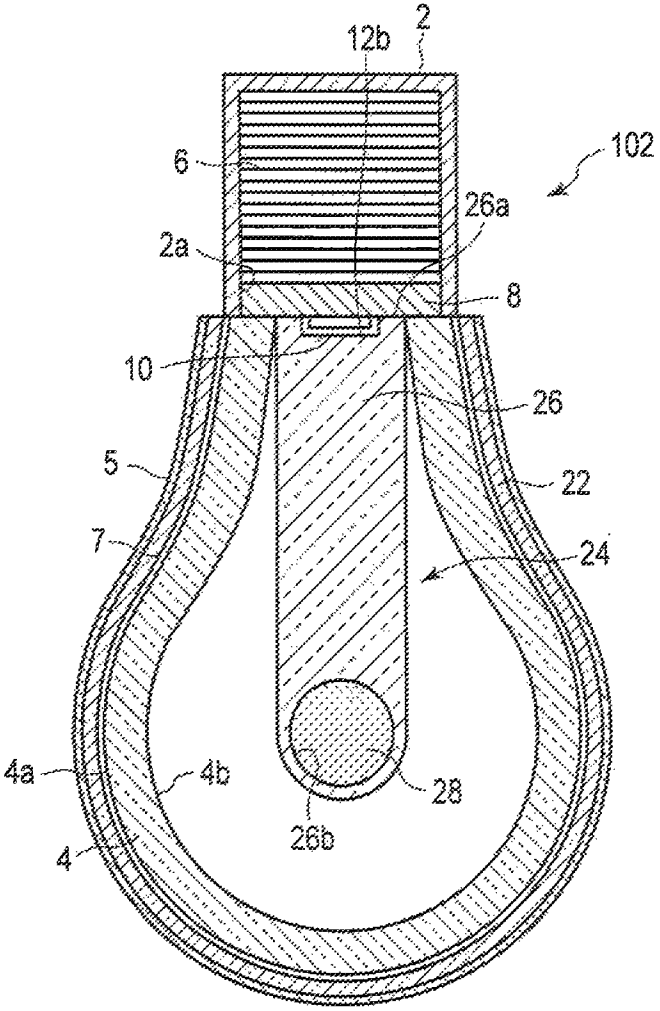
FIG. 2B is a cross-sectional view of the lighting apparatus according to the second embodiment.
Figure 2A:
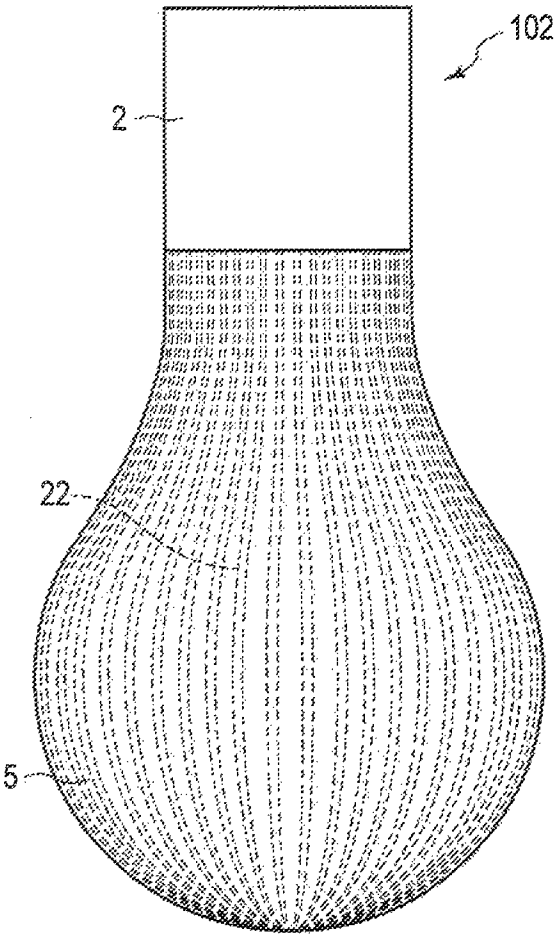
FIG. 2A is a diagram of the appearance of a lighting apparatus according to a second embodiment.

FIG. 2A is a diagram showing the appearance of a LED light bulb 102 according to a second embodiment. FIG. 2B is a cross-sectional view of the LED light bulb 102 vertically divided into two positions along a plane passing through the tube axis of the LED light bulb 102.

The LED light bulb 102 according to the second embodiment is similar in structure to a LED light bulb 101 according to the first embodiment, except that a plurality of thin metal lines 22 is provided between the protective member 5 and the air space 7, and that a luminant 24 is provided instead of a lens 12. Therefore, in the second embodiment, components of the LED light bulb 102 which function similarly to corresponding components of the LED light bulb 101 according to the first embodiment are denoted by the same reference numbers and will not be described below in detail.

Each of the thin metal lines 22 contacts an end surface of a base 2 at one end of the thin metal line 22 (an upper end shown in FIG. 2B), and the other end of the thin metal line 22 extends to a top of the globe 4 (the lowermost end shown in FIG. 2B). The plurality of thin metal lines 22 may be formed of, for example, another transparent heat transfer material in order to prevent transmission of light emitted to the outside of the LED light bulb 102 via the protective member 5. According to the second embodiment, the transparency of the LED light bulb 102 is prevented from being lost by adjusting, for example, the wire diameter and number of plurality of thin metal lines 22 and the intervals between the thin metal lines 22.

The plurality of thin metal lines 22 functions to assist in releasing heat from the LED light bulb 102 through the globe 4. In other words, each of the thin metal lines 22 effectively transfers the heat of the globe 4 to the protective member 5, while transferring the heat of the base 2 throughout the light emitting section of the LED light bulb 102. Thus, the second embodiment enhances the heat radiation performance more than the first embodiment.

Furthermore, to protect the globe 4 from external impact, the plurality of thin metal lines 22 has a function to protect the globe 4. The plurality of thin metal lines 22 may be in the form of a mesh.

The luminant 24 comprises an elongated light guiding member 26 formed of the same material as that of a lens 12 and a spherical scatterer 28. The light guiding member 26 comprises a back surface 26*a* that is in contact with a front surface 8*a* of a substrate 8 and a spherical housing section 26*b* located near a lower end of the light guiding section 26 and in which the scatterer 28 is housed. The light guiding section 26 has a length with which the spherical housing section 26*b* can be placed in the center of the globe 4. The back surface 26*a* comprises a recess 12*b* in which a light source 10 is housed in a noncontact state.

The scatterer 28 is formed of a powder of titanium oxide with a particle size of 1 μm to 10 μm sealed with transparent resin and shaped into a sphere. To allow the scatterer 28 to be placed in the spherical housing section 26*b*, the light guiding section 26 is structured so that the housing section 26*b* is divided into two portions. The light guiding section 26 is assembled by housing the scatterer 28 in the portions of the housing section 26*b* and laminating the portions together.

The luminant 24 comprises the scatterer 28 in order to illuminate the center of the globe 4 of the LED light bulb 102. The shining center of the LED light bulb 102 illuminates the LED light bulb 102 like a common incandescent light bulb.

Third Embodiment

Figure 3B:
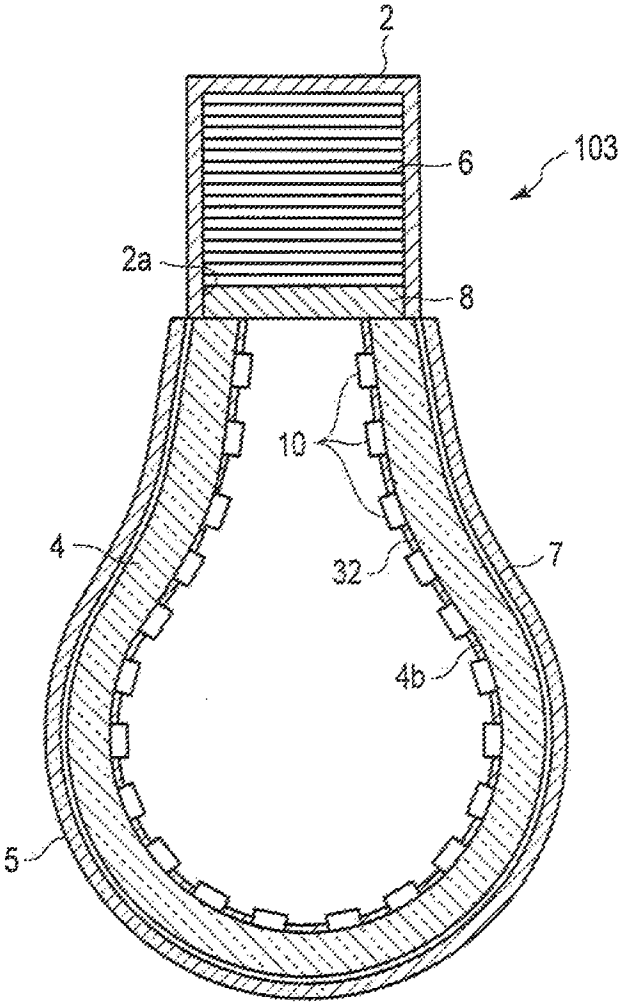
FIG. 3B is a cross-sectional view of the lighting apparatus according to the third embodiment.
Figure 3A:
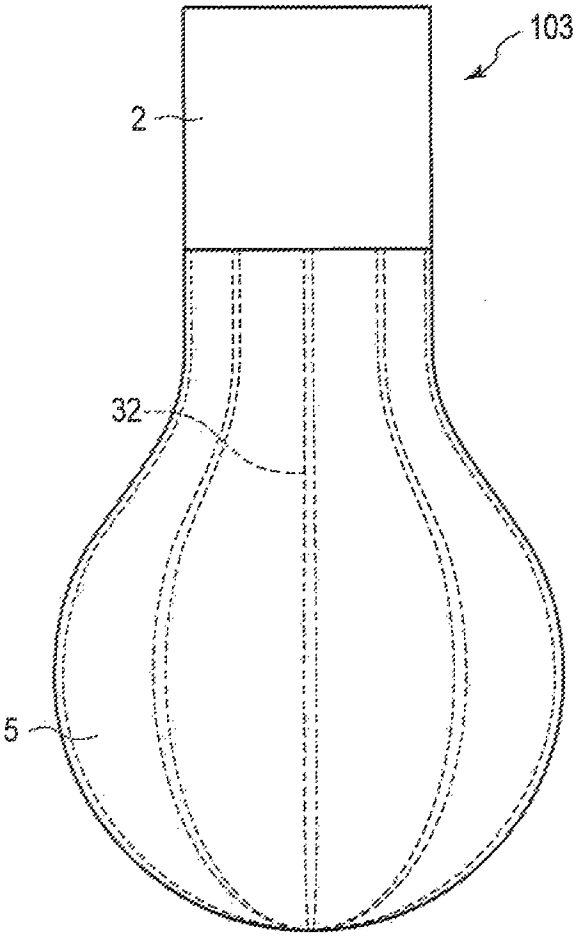
FIG. 3A is a diagram of the appearance of a lighting apparatus according to a third embodiment.

FIG. 3A is a diagram showing the appearance of a LED light bulb 103 according to the third embodiment. FIG. 3B is a cross-sectional view of the LED light bulb 103 vertically divided into two portions along a plane passing through the tube axis of the LED light bulb 103.

The LED light bulb 103 according to the third embodiment is similar in structure to the LED light bulb 101 according to the first embodiment in that the LED light bulb 103 does not comprise a lens 12, and that a light source 10 is placed on an inner surface 4*b* of a globe 4. Therefore, in the third embodiment, components of the LED light bulb 103 which function similarly to corresponding components of the LED light bulb 101 according to the first embodiment are denoted by the same reference numbers and will not be described below in detail.

The LED light bulb 103 according to the third embodiment comprises a plurality of light sources 10. The light sources 10 are bonded and fixed to the inner surface 4*b* of the globe 4 via a transparent heat transfer adhesive (heat transfer means). Wires 32 through which electricity is fed to the light sources 10 are formed of transparent ITO (Indium Tin Oxide). The wires 32 are formed on the inner surface 4*b* of the globe 4 so as to extend straight from an end surface of a base 2 to a top of the globe 4.

As shown in FIG. 3A, the plurality of wires 32 is provided at regular intervals, and thus, the plurality of light sources 10 is laid out so as to be widely distributed all over the surface 4*a* of the globe 4. Consequently, the third embodiment allows a heat source to be distributed all over a light emitting section of the LED light bulb 103, allowing the heat in the LED light bulb 103 to be evenly radiated throughout the LED light bulb 103.

Furthermore, according to the third embodiment, a light emitting surface of each of the light sources 10 faces inward to allow for further light diffusion. This enables a reduction in the glare of the light.

Fourth Embodiment

Figure 4B:
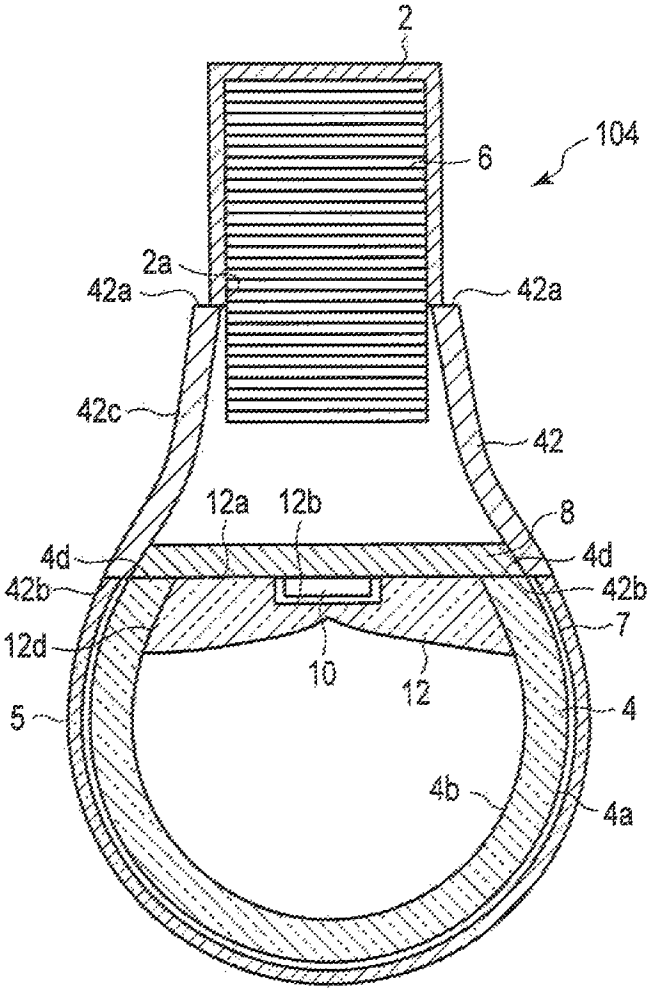
FIG. 4B is a cross-sectional view of the lighting apparatus according to the fourth embodiment.
Figure 4A:
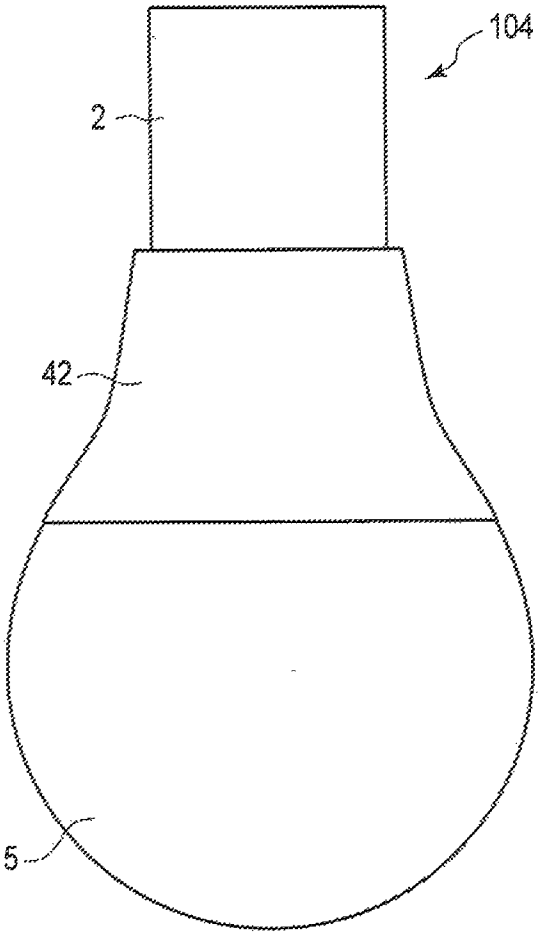
FIG. 4A is a diagram of the appearance of a lighting apparatus according to a fourth embodiment.

FIG. 4A is a diagram showing the appearance of a LED light bulb 104 according to a fourth embodiment. FIG. 4B is a cross-sectional view of the LED light bulb 104 vertically divided into two portions along a plane passing through the tube axis of the LED light bulb 104.

The LED light bulb 104 according to the fourth embodiment is similar in structure to the LED light bulb 101 according to the first embodiment except that the LED light bulb 104 comprises an enclosure 42 provided between a base 2 and a substrate 8 to thermally connect the base 2 and the substrate 8 together. Therefore, in the fourth embodiment, components of the LED light bulb 104 which function similarly to corresponding components of the LED light bulb 101 according to the first embodiment are denoted by the same reference numbers and will not be described below in detail.

The enclosure 42 has a generally cylindrical structure that expands gradually from an end surface of the base 2 toward an end surface 4*d* of the globe 4. An end surface 42*a* with a relatively small diameter (an upper end surface in FIG. 4B) is in contact with the end surface of the base 2. An end surface 42*b* with a relatively large diameter (a lower end surface in FIG. 4B) is in contact with the end surface 4*d* of the globe 4 and an end surface of a protective member 5. The enclosure 42 is preferably formed of a metal material such as aluminum which has excellent heat conductivity.

The substrate 8 is placed in the enclosure 42 by being fitted into the end surface 42*b* with a relatively large diameter and joined to the enclosure 42 with a sheet, an adhesive tape, thermal grease, or the like which has excellent heat conductivity. The sheet, adhesive tape, thermal grease, or the like which has excellent heat conductivity is also provided between the end surface 42*a* of the enclosure 42 having a relatively small diameter and the end surface of the base 2 and the end surface 42*b* of the enclosure 42 having a relatively large diameter and the globe 4.

Heat from the light source 10 is transferred through a path similar to the path in the first embodiment and to the enclosure 42 via the substrate 8. Furthermore, heat generated by the power supply circuit 6 is transferred via the base 2 or directly to the enclosure 42. The enclosure 42 allows the heat from the light source 10 and the power supply circuit 6 to be internally transferred and releases a portion of the heat to the external space through an outer surface 42*c* as a result of convection and radiation.

When the enclosure 42 is provided between the base 2 and the globe 4 as in the case of the fourth embodiment, the LED light bulb 104 comprises a reduced light emitting surface and appears differently from an incandescent light bulb. However, the LED light bulb 104 provided with the metal enclosure 42 with high heat conductivity exhibits enhanced heat radiation performance compared to the LED light bulb 101 according to the first embodiment.

Fifth Embodiment

Figure 5B:
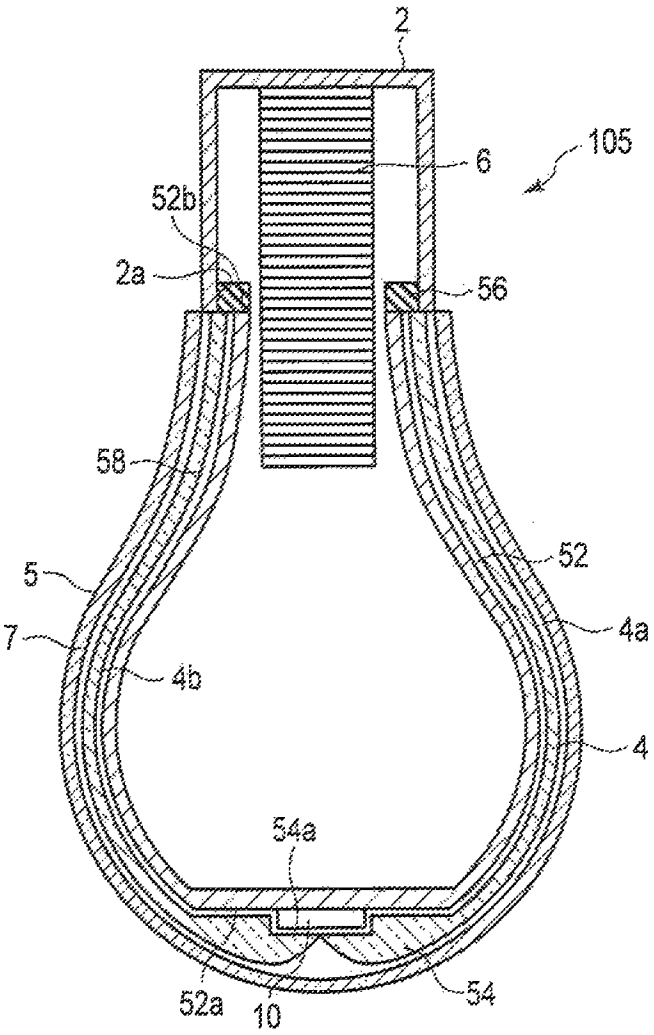
FIG. 5B is a cross-sectional view of the lighting apparatus according to the fifth embodiment.
Figure 5A:
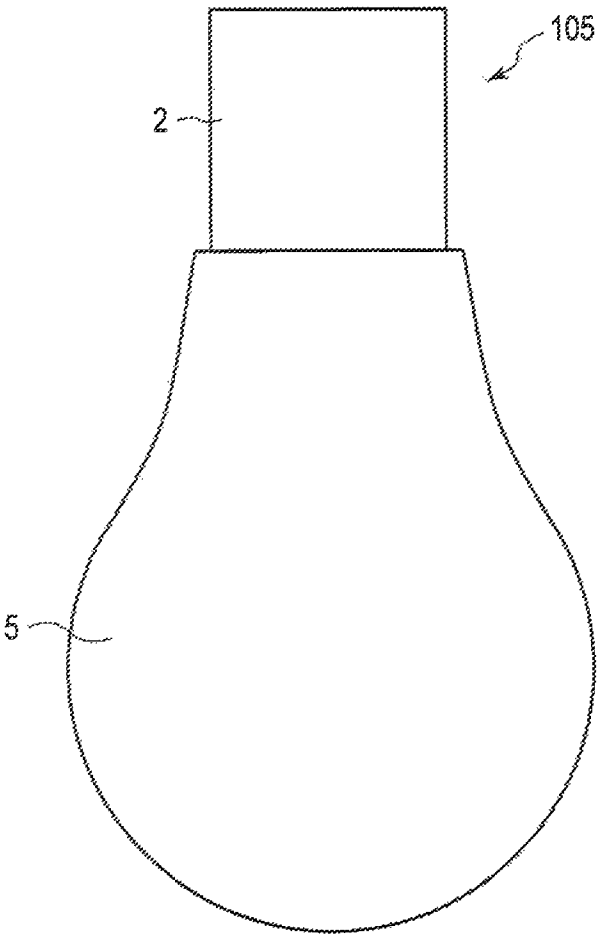
FIG. 5A is a diagram of the appearance of a lighting apparatus according to a fifth embodiment.

FIG. 5A is a diagram showing the appearance of a LED light bulb 105 according to a fifth embodiment. FIG. 5B is a cross-sectional view of the LED light bulb 105 vertically divided into two portions along a plane passing through the tube axis of the LED light bulb 105.

The LED light bulb 105 according to the fifth embodiment is similar in structure to the LED light bulb 101 according to the first embodiment except for the following aspects: the LED light bulb 105 comprises, instead of a substrate 8, an enclosure 52 (back surface side heat transfer member) shaped generally like a spherical shell, a light source 10 provided on a mounting surface 52*a* at a lower end of the enclosure 52, a top of a globe 4 opposite to the light source 10 configured to function as a lens 54, and the lens 54 comprises a recess 54*a* (light receiving surface) formed on a back surface side of the lens 54 and in which the light source 10 is housed and arranged. Therefore, in the fifth embodiment, components of the LED light bulb 105 which function similarly to corresponding components of the LED light bulb 101 according to the first embodiment are denoted by the same reference numbers and will not be described below in detail.

An end surface 52*b* at an upper end, shown in FIG. 5B, of the enclosure 52 is in contact with a ring-like metal heat transfer member 56 fitted in an opening 2*a* of a base 2 and is thermally joined to the base 2. The enclosure 52 is preferably formed of metal such as aluminum which has high heat conductivity. The enclosure 52 is internally filled with air but may be vacuumized.

The enclosure 52 receives heat generated by the light source 10 via the mounting surface 52*a* to transfer the heat throughout the enclosure 52 and to the base 2 via the heat transfer member 56. In contrast, heat from a power supply circuit 6 is transferred to the enclosure 52 via the base 2 and the heat transfer member 56. According to the fifth embodiment, the light source 10 serving as a heat source and the power supply circuit 6 can be arranged to be separated from each other. This allows the heat in the LED light bulb 105 to be evenly radiated throughout the LED light bulb 105, enabling an increase in heat radiation efficiency.

Now, the appropriate thickness of the enclosure 52 to enhance the heat radiation performance will be discussed.

When the enclosure 52 is shaped approximately like a spherical shell and the tube axis is set to correspond to a central axis, longitudinal heat resistance $R_{t1}$ is expressed by:

[Formula 4]

$$R_{tl} = \frac{\ln\left\{\frac{(\cos\theta_2 - 1)(\cos\theta_1 + 1)}{(\cos\theta_2 + 1)(\cos\theta_1 - 1)}\right\}}{4\lambda\pi(r_2 - r_1)} \quad (\text{式 } 4)$$

Figure 11:
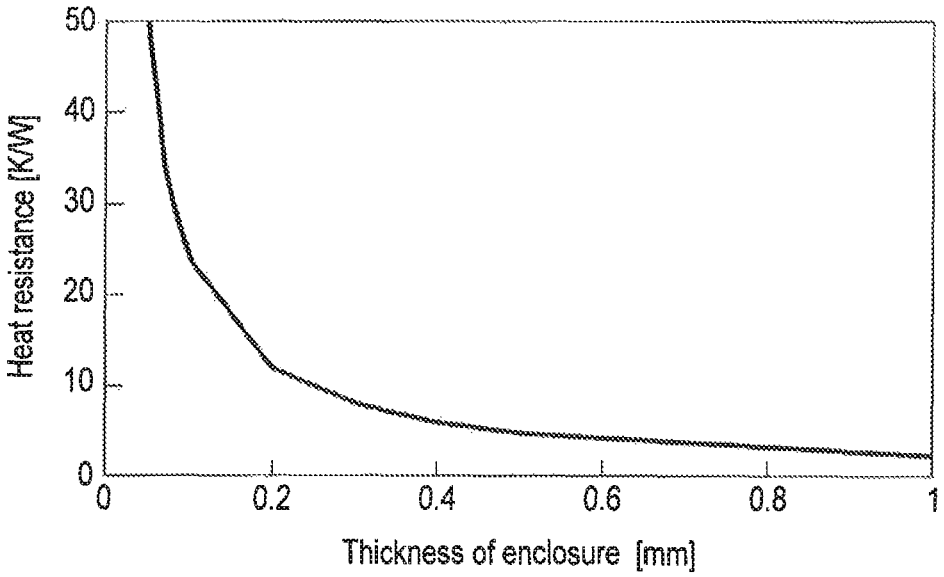
FIG. 11 is a graph showing the relation between the thickness and thermal resistance of an enclosure.

In Formula 4, the inner radius of the spherical shell is denoted by $r_1$, the outer radius of the spherical shell is denoted by $r_2$, the latitude is denoted by $\theta_1$ and $\theta_2$, and the coefficient of heat conductivity is denoted by $\lambda$. A light bulb including an E26 base and having a diameter $\phi$ of 55 mm and an overall length of 98 mm has about 108 $cm^2$ in surface area except for the base 2. A spherical shell with the same surface area has an outer radius of about 30 mm. Taking the diameter of the base 2 into consideration, $\theta_2$ is about 153°, and the angle $\theta_1$, which divides the surface area of the sphere approximately into two portions, is about 87°. When a material for the globe 4 is aluminum (120 W/mK), the relation between the thickness and heat resistance of the enclosure 52 is as shown in FIG. 11. For heat radiation from the globe 4, $R_{t1}$ is preferably equal to or lower than 30K/W. Thus, the thickness of the enclosure 52 is preferably equal to or larger than approximately 0.08 mm.

In the LED light bulb 105 according to the fifth embodiment, light emitted by the light source 10 is transferred as described below.

The globe 4 guides (propagates) light traveling from the recess 54*a* side through the lens 54, located opposite the light source 10, while totally reflecting the light so that the light travels between the inner surface 4*b* and a surface 4*a* of the globe 4. The inner surface 4*b* or surface 4*a* of the globe 4 is provided with scatter marks (not shown in the drawings) formed, for example, by silk printing or notching in order to scatter light. A portion of light propagating though the globe 4 with the scatter marks is taken out via the surface 4*a* and utilized as illumination light.

A support member (not shown in the drawings) is also arranged between an outer surface of the enclosure 52 and the inner surface 4*b* of the globe 4 to form a gap 58 with a distance d. The gap 58 is, for example, an air space. At least one support member (not shown in the drawings) is provided between the enclosure 52 and the inner surface 4*b* of the globe 4. The support member is, for example, a cylindrical member.

Now, the thickness of the air space, that is, the appropriate value of the distance d of the gap 58, will be discussed.

The distance d is basically set larger than the wavelength $\lambda$ of light emitted by the light source 10. Moreover, in order to allow heat to be easily transferred from the enclosure 52 to the globe 4, the distance d is minimized within an acceptable range in connection with the accuracy of machining of the scatter marks, the support members, and the like; the distance d is preferably set to approximately 0.01 mm to approximately 1.0 mm.

Figure 12:
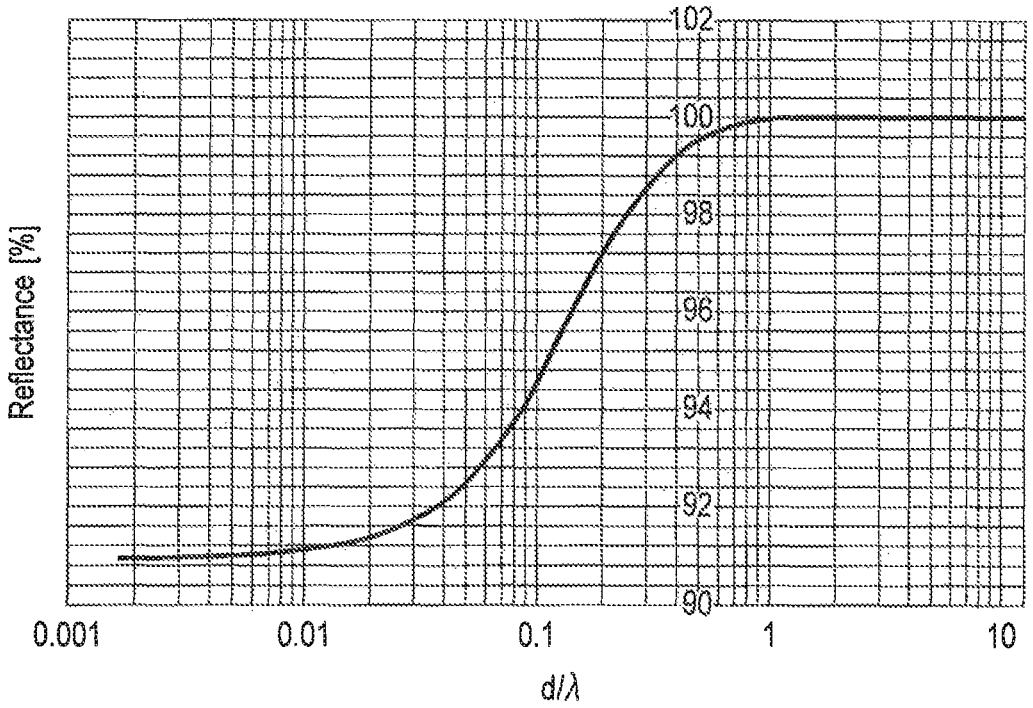
FIG. 12 is a graph showing d/λ and reflectance.

FIG. 12 is a graph showing the relation between $d/\lambda$ and reflectance observed when light is totally reflected inside the globe 4 at an incident angle of 45° if the globe 4 is formed of acrylic and if the enclosure 42 is formed of aluminum. FIG. 12 indicates that, for $d/\lambda>1$, that is, $d>\lambda$, the reflectance is nearly 100% and that, for $d/\lambda<1$, that is, $d<\lambda$, light is absorbed by the enclosure 42, with the reflectance decreasing toward d=0.

Thus, in the LED light bulb 105 according to the fifth embodiment, the gap 58 of the distance d is provided between the outer surface of the enclosure 52 and the inner surface 4*b* of the globe 4. This allows the reflectance of light guided inside the globe 4 to be set to nearly 100%. That is, most of the light guided inside the globe can be taken out through the surface 4*a*, enabling a reduction in loss of light resulting from absorption of light by the enclosure 52. This means that light is prevented from propagating to the enclosure 52 due to an evanescent wave, enabling a reduction in loss of light.

Sixth Embodiment

Figure 6B:
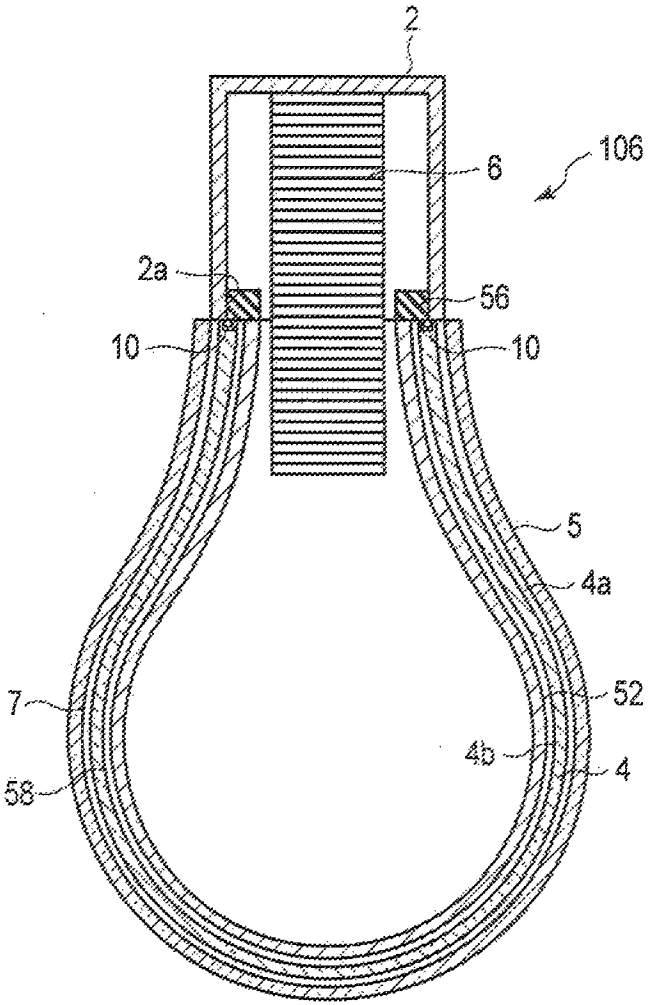
FIG. 6B is a cross-sectional view of the lighting apparatus according to the sixth embodiment.
Figure 6A:
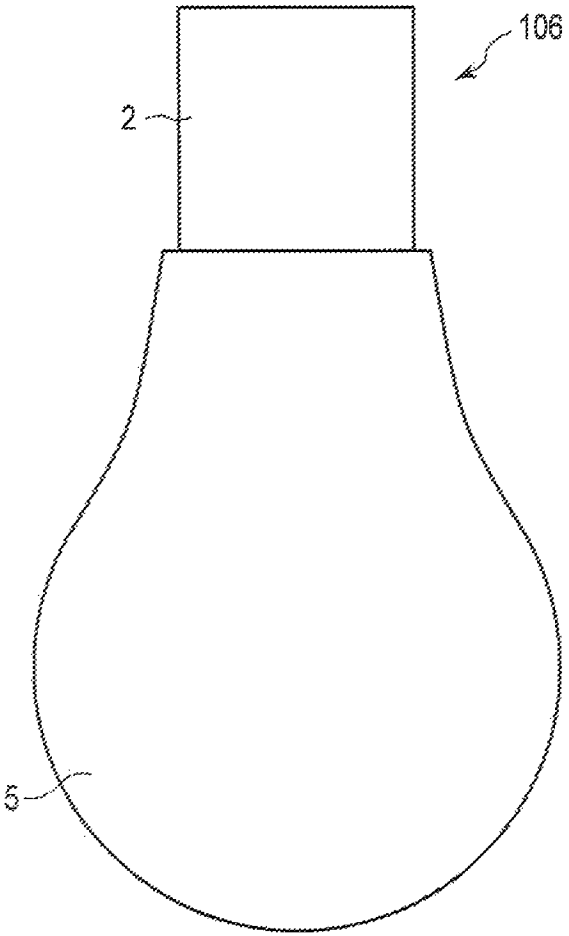
FIG. 6A is a diagram of the appearance of a lighting apparatus according to a sixth embodiment.

FIG. 6A is a diagram showing the appearance of a LED light bulb 106 according to a sixth embodiment. FIG. 6B is a cross-sectional view of the LED light bulb 106 vertically divided into two portions along a plane passing through the tube axis of the LED light bulb 106.

The LED light bulb 106 is structured such that a plurality of light sources 10 is arranged along a ring-like end surface 4*d* at an upper end of a globe 4 and that a lens 54 is not provided at a top of the globe 4. The remaining part of the structure of the LED light bulb 106 according to the sixth embodiment is similar to the corresponding part of the structure of the LED light bulb 105 according to the fifth embodiment. Therefore, in the sixth embodiment, components of the LED light bulb 106 which function similarly to corresponding components of the LED light bulb 105 according to the fifth embodiment are denoted by the same reference numbers and will not be described below in detail.

The sixth embodiment enables a reduction in the thickness of an area of the globe 4 corresponding to a lower end of the LED light bulb 106.

Seventh Embodiment

Figure 7B:
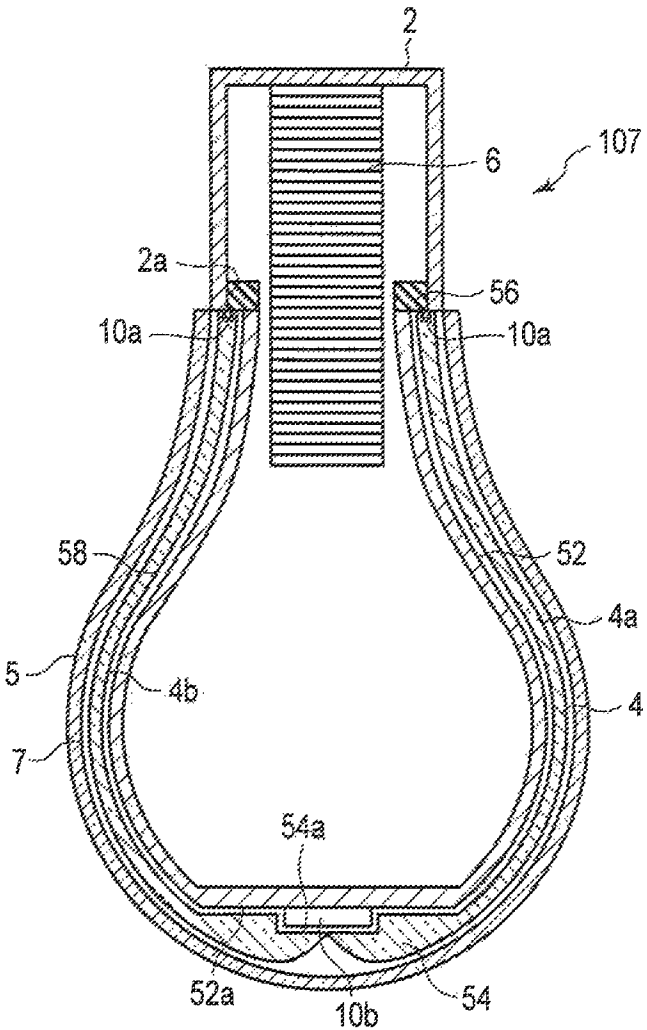
FIG. 7B is a cross-sectional view of the lighting apparatus according to the seventh embodiment.
Figure 7A:
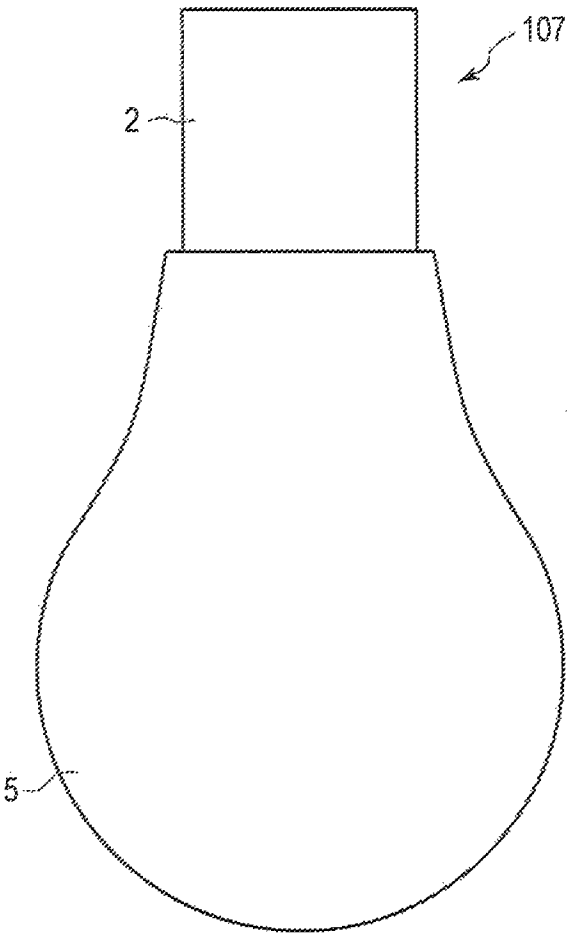
FIG. 7A is a diagram of the appearance of a lighting apparatus according to a seventh embodiment.

FIG. 7A is a diagram showing the appearance of a LED light bulb 107 according to a seventh embodiment. FIG. 7B is a cross-sectional view of the LED light bulb 107 vertically divided into two portions along a plane passing through the tube axis of the LED light bulb 107.

The LED light bulb 107 has a structure resulting from a combination of a LED light bulb 105 according to the fifth embodiment with a LED light bulb 106 according to the sixth embodiment. Therefore, also in the seventh embodiment, components of the LED light bulb 107 which function similarly to corresponding components of the LED light bulbs 105 and 106 are denoted by the same reference numbers and will not be described below in detail.

According to the seventh embodiment, a plurality of light sources 10*a* is arranged on an end surface 4*d* of the globe 4, and a light source 10*b* is arranged near a top of the LED light bulb 107. Thus, the light sources 10*a* and 10*b*, which correspond to heat sources, can be separated from each other across a metal enclosure 52. This enables the heat of the enclosure 52 to be evenly radiated throughout the enclosure 52, and a more even distribution of light emission from the globe 4.

Eighth Embodiment

Figure 8B:
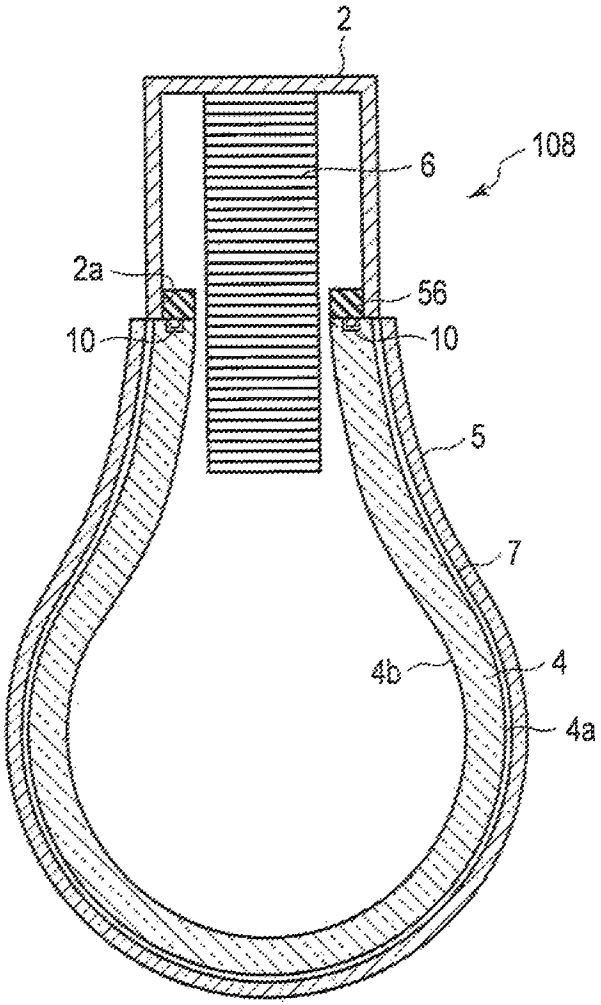
FIG. 8B is a cross-sectional view of the lighting apparatus according to the eighth embodiment.
Figure 8A:
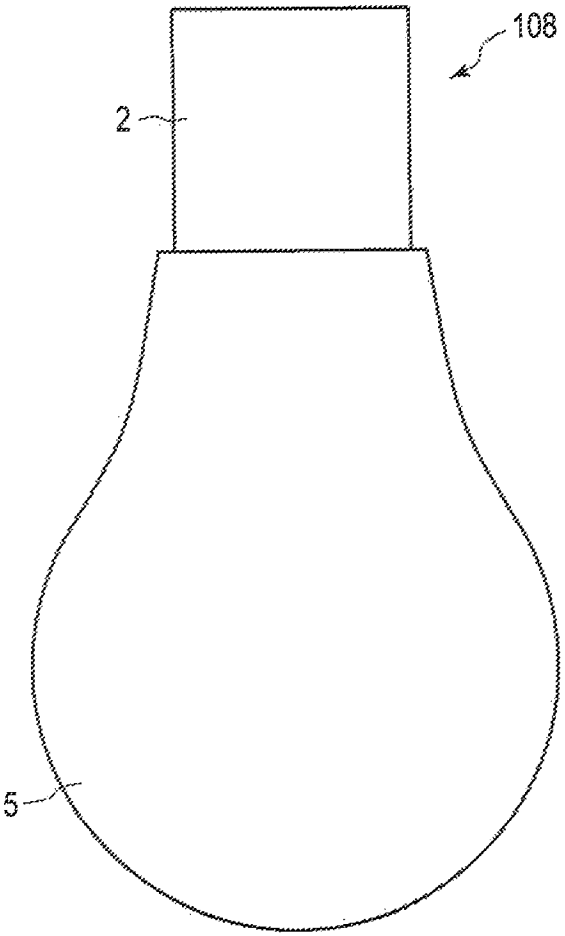
FIG. 8A is a diagram of the appearance of a lighting apparatus according to an eighth embodiment.

FIG. 8A is a diagram showing the appearance of a LED light bulb 108 according to an eighth embodiment. FIG. 8B is a cross-sectional view of the LED light bulb 108 vertically divided into two portions along a plane passing through the tube axis of the LED light bulb 108.

The LED light bulb 108 according to the eighth embodiment is similar in structure to the LED light bulb 106 according to the sixth embodiment except that the LED light bulb 108 omits an enclosure 52 located opposite an inner surface 4*b* of a globe 4, to increase the thickness of the globe 4. Therefore, in the eighth embodiment, components of the LED light bulb 108 which function similarly to corresponding components of the LED light bulb 106 are denoted by the same reference numbers and will not be described below in detail.

The LED light bulb 108 according to the eighth embodiment omits the opaque enclosure 52 extending along the globe 4, resulting in a transparent appearance.

According to at least one of the above-described embodiments, the transparent heat transfer member is located near the light source 10. The embodiment can thus provide a lighting apparatus which has a high light output ratio and which has excellent heat radiation and heat resistance.

While certain embodiments have been described, these embodiments have been presented by way of example only, and are not intended to limit the scope of the inventions. Indeed, the novel embodiments described herein may be embodied in a variety of other forms; furthermore various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A lighting apparatus comprising:

a light source configured to generate heat;

a transparent heat transfer member located near the light source and having transparency to visible light, a heat-resistant temperature equivalent to or greater than that of the light source, and heat conductivity;

a heat transfer means for transferring heat from the light source to the transparent heat transfer member; and a protective member that:

is formed of a material that:

is transparent or translucent to visible light, has a heat-resistant temperature equivalent to or greater than that of the light source, has a mechanical strength sufficient to withstand impacts when dropped, has flame retardance, and is different from the transparent heat transfer member; and covers a surface of the transparent heat transfer member.

2. The lighting apparatus of claim 1, wherein the heat transfer means is a transparent member with a light receiving surface located near and opposite a light emitting surface of the light source, and the transparent member is in tight contact with and transfers heat to the transparent heat transfer member.

3. The lighting apparatus of claim 2, wherein:

the heat transfer means is a glass lens having: a back surface which contacts a surface of a substrate on which the light source is provided, a recess which is provided on the back surface and in which the light source is housed and arranged in a non-contact state, a surface which refracts light that passes through to distribute the light, and a side surface which is in tight contact with the transparent heat transfer member.

4. The lighting apparatus of claim 1, wherein the transparent heat transfer member is a glass globe having a transmittance of 92% or higher, a heat-resistant temperature of 100° C. or higher, and heat conductivity of 1.0 W/mK or higher.

5. The lighting apparatus of claim 4, wherein the globe has a means for diffusing light.

6. The lighting apparatus of claim 4, wherein the light source is provided on an inner surface of the globe, and the heat transfer means is an adhesive having transparency and heat conductivity and bonding the light source to an inner surface of the globe.

7. The lighting apparatus of claim 4, wherein at least one of the globe and the protective member has light diffusivity.

8. The lighting apparatus of claim 5, wherein the means for diffusing light includes a scatterer provided on an inner surface or a surface of the globe.

9. The lighting apparatus of claim 1, wherein the transparent heat transfer member is a glass globe having a transmittance of 92% or higher, a heat-resistant temperature of 100° C. or higher, and heat conductivity of 1.0 W/mK or higher, and the heat transfer means is a glass lens having a heat-resistant temperature of 100° C. or higher and heat conductivity of 1.0 W/mK or higher.

10. The lighting apparatus of claim 1, wherein the transparent heat transfer member has a light receiving surface located near and opposite a light emitting surface of the light source.

11. The lighting apparatus of claim 1, further comprising a power supply circuit configured to supply electricity to the light source.

12. The lighting apparatus of claim 1, wherein the light source is a LED, and the transparent heat transfer member and the heat transfer means for transferring heat to the transparent heat transfer member have heat resistance at least equivalent to heat resistance of the LED.

13. The lighting apparatus of claim 1, further comprising a back surface side he at transfer member having heat conductivity and to which the light source is attached.

14. The lighting apparatus of claim 13, wherein the back surface side heat transfer member is a metal enclosure having excellent heat conductivity.

15. The lighting apparatus of claim 13, wherein the back surface side heat transfer member is a substrate on which the light source is mounted.

16. The lighting apparatus of claim 1, wherein the protective member:

has a light transmittance of 85% or higher, has a heat-resistant temperature of 100° C. or higher, has a mechanical strength sufficient to withstand impacts when dropped, and has flame retardance.

17. The lighting apparatus of claim 1, further comprising:

an air layer provided between the surface of the transparent heat transfer member and the protective member.

* * * * *